US005489496A

United States Patent [19]

Katayama et al.

[11] Patent Number: 5,489,496

[45] Date of Patent: Feb. 6, 1996

[54] ELECTROPHOTOGRAPHIC PHOTOCONDUCTOR AND A METHOD FOR FORMING THE SAME

[75] Inventors: Satoshi Katayama; Satoshi Nishigaki, both of Nara; Kazuhiro Emoto, Nagaokakyo; Hiroshi Sugimura, Habikino; Kazushige Morita; Yoshimi Kojima, both of Nara; Yoshimasa Fujita, Tenri, all of Japan

[73] Assignee: Sharp Kabushiki Kaisha, Osaka, Japan

[21] Appl. No.: 277,020

[22] Filed: Jul. 19, 1994

[30] Foreign Application Priority Data

Jul. 20, 1993 [JP] Japan ..... 5-178916
Jul. 13, 1994 [JP] Japan ..... 6-161611

[51] Int. Cl.[6] ..... G03G 5/14

[52] U.S. Cl. ..... 430/62; 430/60; 430/65; 430/131; 430/58

[58] Field of Search ..... 430/60, 63, 65, 430/131

[56] References Cited

U.S. PATENT DOCUMENTS

| | | | |
|---|---|---|---|
| 4,377,629 | 3/1983 | Tarumi et al. | 430/63 X |
| 4,518,669 | 5/1985 | Yashiki | 430/63 X |
| 4,775,605 | 10/1988 | Seki et al. | 430/63 |

FOREIGN PATENT DOCUMENTS

| | | | |
|---|---|---|---|
| 0576957 | 1/1994 | European Pat. Off. | 430/63 |
| 51-114132 | 10/1976 | Japan . | |
| 55-25030 | 2/1980 | Japan . | |
| 56-52757 | 12/1981 | Japan . | |
| 58-95351 | 6/1983 | Japan . | |
| 59-93453 | 5/1984 | Japan . | |
| 63-234261 | 9/1988 | Japan . | |
| 63-298251 | 12/1988 | Japan . | |
| 298251 | 12/1988 | Japan | 430/60 |
| 2-181158 | 7/1990 | Japan . | |
| 181158 | 7/1990 | Japan | 430/131 |

*Primary Examiner*—Roland Martin
*Attorney, Agent, or Firm*—Nixon & Vanderhye

[57] ABSTRACT

An electrophotographic photoconductor comprising a conductive support, an undercoating layer provided on the conductive support and a photosensitive layer provided on the undercoating layer, in which the undercoating layer comprises a needle-like titanium oxide particles and a binder resin. The needle-like titanium oxide particles in the undercoating layer show a volume resistance in the range from $10^5$ Ω·cm to $10^{10}$ Ω·cm when a loading pressure of 100 Kg/cm$^2$ is applied and have a short axis S having a length of 0.5 μm or less and a long axis L having a length of 10 μm or less and the aspect ratio of L/S ranging from 2 to 10. Further, the needle-like titanium oxide particles are contained in the undercoating layer in the range from 50 wt % to 95 wt % and the surface thereof remains untreated.

9 Claims, 1 Drawing Sheet

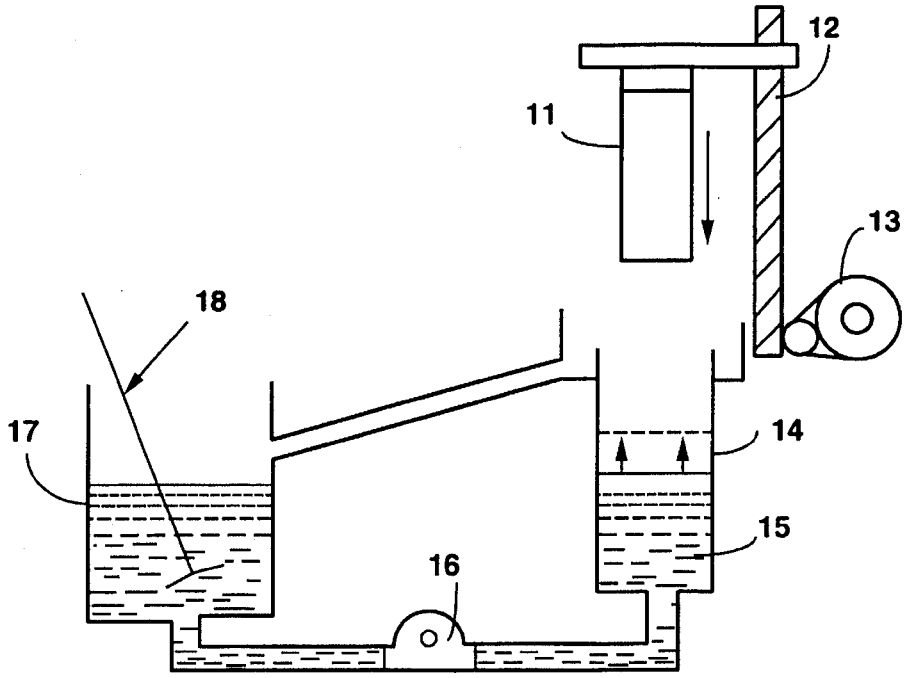
Fig. 1
Fig. 2
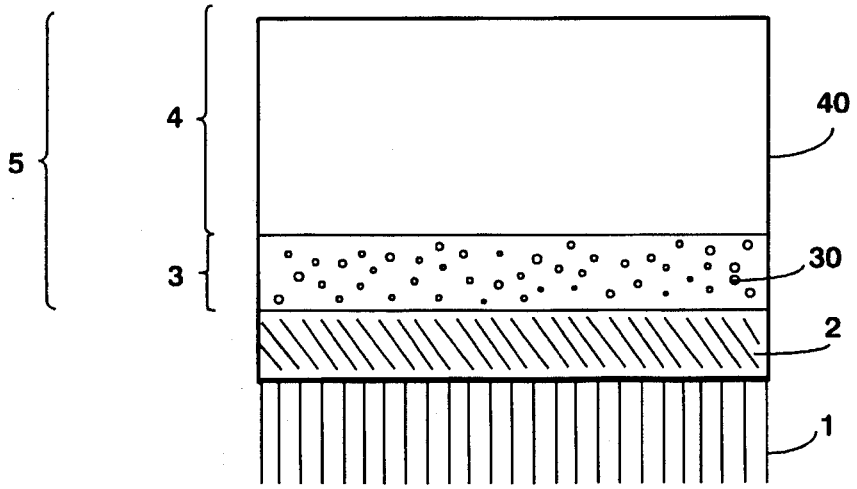

ELECTROPHOTOGRAPHIC PHOTOCONDUCTOR AND A METHOD FOR FORMING THE SAME

BACKGROUND OF THE INVENTION

1. Field of the Invention

The invention relates to an electrophotographic photoconductor. In particular, it relates to an electrophotographic photoconductor comprising a conductive support, undercoating layer and photosensitive layer.

2. Description of the Related Art

An electrophotographic process using a photoconductor comprises the steps of placing the photoconductor in the dark and charging the surface thereof evenly by corona discharge, exposing a region to selectively discharge electric charges and form an electrostatic image in the nonexposed region, and subsequently depositing the colored charged particles (toner) to a latent image by electrostatic attraction and the like to visualizing it, thereby forming an image.

Primary characteristics required of photoconductors in the above serial process are as follows.

(1) It can be charged evenly to a suitable potential in a dark place.

(2) It has a high chargeability in a dark place and electric charges are less discharged.

(3) It has an excellent photosensitivity and discharges electric charges immediately by exposure.

Further, photoconductors needed to have stability and durability, for example, little residual potential because of easy discharge of the surface of the photoconductor; excellent mechanical strength and flexibility; stable electric properties with no change of chargeability, photosensitivity, residual potential and the like even after repeated use; and endurance against heat, light, temperature, humidity, ozone deterioration and the like.

Electrophotographic photoconductors are currently used for practical purposes. Such photoconductors are prone to generate carrier implantation from the surface of the conductive support, so that image defects are produced because of disappearance of or decrease in surface charges form a microscopic view. In order to solve the problem, and further to coat defects of the surface, to improve the charging properties and to improve adhesive and coating properties of the photosensitive layer, an undercoating layer is provided between the conductive support and photosensitive layer.

Conventional undercoating layers contain various type of resin materials and those containing titanium oxide powder or the like. Known materials for the undercoating layers formed of a single layer include resin materials such as polyethylene, polypropylene, polystyrene, acryl resins, vinyl chloride resins, vinyl acetate resins, polyurethane resins, epoxy resins, polyester resins, melamine resins, silicon resins, polyvinyl buthyral resins, polyamide resins; and copolymer having more than two repeating units of these resins; casein, gelatin, polyvinyl alcohol, ethyl cellulose and the like. Among them, polyamide resin is preferable (disclosed in Japanese Unexamined Patent Publication Sho 51 (1976)-114132 and Japanese Unexamined Patent Publication Sho 52 (1977)-25638). However, the electrophotographic photoconductors having a single layer formed of polyamide etc. as an undercoating layer have a defect of great residual potential storage, which reduces sensitivity and induces an overlap of an image. This tendency becomes conspicuous under a low humidity.

Therefore, for preventing the image defect and improving residual potential, Japanese Unexamined Patent Publication Sho 56 (1981)-52757 discloses an undercoating layer containing surface-untreated titanium oxide. In addition, Japanese Unexamined Patent Publication Sho 59 (1984)-93453 and Japanese Unexamined Patent Publication Hei 2 (1990)-81158 disclose an undercoating layer containing in the surface titanium oxide particles coated with alumina and the like for improving dispersion of the titanium oxide powder. Further, Japanese Unexamined Patent Publication Sho 63 (1988)-234261 and Japanese Unexamined Patent Publication Sho 63 (1988)-298251 propose an undercoating layer comprising titanium oxide particles and binder resin in which the mixing ratio of titanium oxide is optimized for prolongation of the life of photoconductors.

In the above described undercoating layer containing titanium oxide powder, titanium oxide having a grain-like shape has been used.

Coating methods used for forming the electrophotographic photoconductor include a spray method, bar coat method, roll coat method, blade method, ring method, dip coating method and the like. According to the dip coating method shown in FIG. 1, the electrophotographic photoconductor is formed by immersing a conductive support in a coating tank filled with a coating solution for the photosensitive layer and pulling up the immersed conductive support at a constant or changing speed. The dip coating method is often used for forming an electrophotographic photoconductor because it is relatively simple and excellent in productivity and cost.

Preferably, resins used for the undercoating layer are hardly soluble in a solvent of the coating solution for the photosensitive layer. Generally, either alcohol soluble or water soluble resin is used. The undercoating layer is formed by preparing an alcohol solution or dispersed solution of the resign as a coating solution for the undercoating layer and by coating the support with the coating solution for the undercoating solution.

When the undercoating layer comprises titanium oxide powder and binder resin in which the ratio of titanium oxide is small as compared with the binder resin, the volume resistance of the undercoating layer increases and carriers transportation generated by exposure are controlled or prevented. As a result, the residual potential raises, thereby forming an overlap in an image. Furthermore, when electrophotographic photoconductors are used repeatedly, they are significantly affected by the accumulation of residual potential, temperature and humidity. In particular, the accumulation of residual potential becomes conspicuous at a low humidity, thereby degrading stability and failing to provide sufficient properties of the phoroconductor.

With increase in the content of titanium oxide, these problems are solved. But, if the electrophotographic photoconductor is repeatedly used, the residual potential tends to be stored. Especially, the tenancy is significantly revealed at a low humidity, failing to completely solving the problem of the stability in a long duration and environmental properties.

Moreover, if the titanium oxide content increases to a ratio at which the content of the binder resin becomes virtually zero, the film strength of the undercoating layer decreases and adhesiveness between the undercoating layer and the conductive support is weakened with the result that after repeated use of the photoconductors the photosensitivity thereof is degraded due to the breakage of the film and the image is adversely affected. Additionally, photoconductors have a drawback of an abrupt decrease in volume resistance and low chargeability.

The titanium oxide powder used for the undercoating layer of the conventional invention has a particle size of 0.01 μm or more and 1 μm or less in the observation of the microscope, and the mean of the aspect ratio thereof is in the range of 1 or more to 1.3 or less. The particles have approximately spherical shape (hereinafter referred to "grain-like shape") despite some degree of unevenness. When the titanium oxide dispersed in the undercoating layer has the grain-like shape, the particles come into contact with each other at a point and the contact area thereof is small. Therefore, unless the content of the titanium oxide exceeds a certain level, the resistance of the undercoating layer is significantly high and the photoconductor properties, especially sensitivity and residual potential, are degraded. Accordingly, in case of titanium oxide of the grain-like shape, a larger content of titanium oxide is required in the undercoating layer.

Despite the improvement in the properties with the larger ratio of titanium oxide content, the photoconductor will never fail to be deteriorated through repeated use over a long time because of a weak contact between the particles.

When the content of titanium oxide is increased, the dispersion of titanium oxide to binder resin, in addition, dispersion and stability of the coating solution for the undercoating layer are deteriorated. This produces coating unevenness when the undercoating layer is applied in the process of forming the photoconductor, thereby failing to provide excellent image properties. Therefore, a coating solution for the undercoating layer which satisfies a sufficient dispersion and stability has been demanded.

BRIEF DESCRIPTION OF THE DRAWINGS

FIG. 1 is a schematic view showing an example of a dip coating device used for forming an electrophotographic photoconductor.

FIG. 2 is a sectional view of an electrophotographic photoconductor having a function separated structure formed in an Example of the present invention.

SUMMARY OF THE INVENTION

The present invention provides an electrophotographic photoconductor comprising a conductive support, an undercoating layer provided on the conductive support and a photosensitive layer provided on the undercoating layer, in which the undercoating layer comprises needle-like titanium oxide particles and a binder resin. The needle-like titanium oxide particles in the undercoating layer show a volume resistance in the range from $10^5$ Ω·cm to $10^{10}$ Ω·cm when a loading pressure of 100 Kg/cm$^2$ is applied.

The present invention further provides a method for forming the electrophotographic photoconductor, in which the undercoating layer is formed by using a coating solution comprising the needle-like titanium oxide particles, the binder resin and an organic solvent, the binder resin is a polyamide resin and the organic solvent is a mixture of an azeotropic mixture of $C_{1-3}$ lower alcohol and another organic solvent selected from the group consisting of dichloromethane, chloroform, 1,2-dichloroethane, 1,2-dichloropropane, toluene and tetrahydrofuran.

The azeotropic mixture mentioned above is a mixture solution in which a composition of the liquid phase and a composition of the vapor phase are coincided with each other at a certain pressure to give a mixture having a constant boiling point. The composition is determined by a combination of $C_{1-3}$ lower alcohol and another organic solvent selected from the group consisting of dichloromethane, chloroform, 1,2-dichloroethane, 1,2-dichloropropane, toluene and tetrahydrofuran, which is known by the person skilled in the art. For example, a mixture consisted of 35 parts by weight of methanol and 65 parts by weight of 1,2-dichloroethane is azeotropic solution. The azeotropic composition leads a uniform evaporation, thereby forming an even undercoating layer without coating defects and improving a storage stability of the coating solution for the undercoating layer.

An object of the present invention is to provide an electrophotographic photoconductor having favorable properties such as good chargeability and low residual potential, and being excellent in stability after repeatedly used and in environmental properties such that only a few amount of residual potential is accumulated and the photosensitivity is not degraded after repeated use.

Another object of the present invention is to provide an electrophotographic photoconductor in which the surface of the undercoating layer is so flat that photosensitive layer can be applied evenly, thereby substantially overcoming the defects of the conductive support.

Still another object of the present invention is to provide a method for forming the electrophotographic photoconductor in which the photosensitive layer is evenly coated and which provides an excellent image properties.

Yet another object of the present invention is to provide the coating solution for the undercoating layer having an excellent storage stability which is capable of forming even coating film without aggregation for a long duration.

DESCRIPTION OF PREFERRED EMBODIMENT

Titanium oxide particles used for the undercoating layer of the present invention have a needle-like shape. The term "needle-like" means a long and narrow shape including a stick and pole and it is a shape having an aspect ratio L/S of a length L of the long axis to a length S of the short axis of 1.5 or more. It is not necessary to be extremely long and narrow or have a sharp pointed end. The mean of the aspect ratio is preferably in the range from 1.5 to 300, more preferably from 2 to 10. The short axis and long axis of the particle diameter of the needle-like titanium oxide are 1 μm or less and 100 μm or less, respectively, more preferably, 0.5 μm or less and 10 μm or less, respectively.

Such methods as natural sedimentation method and photo-extinction method and the like may be used for measuring the diameter and aspect ratio. As the titanium oxide particles have a needle-like shape, microscopic observation may be preferably used for measuring the diameter and aspect ratio thereof. The undercoating layer contains the titanium oxide and binder resin. The content of the needle-like titanium oxide particles is in the range from 10 wt % to 99 wt %, preferably from 30 wt % to 99 wt %, most preferably 50 wt % to 95 wt %. In the present invention, the needle-like titanium oxide particles may be used together with titanium oxide having a grain-like shape.

Titanium oxide has two crystal forms including anatase and rutile, both of which can be used for the present invention singly or in combination.

The needle-like titanium oxide fine particles are required to have a volume resistance as high as a level in the range from $10^5$ Ω·cm to $10^{10}$ Ω·cm under a loading pressure of 100 Kg/cm$^2$. Hereinafter, the volume resistance provided when the loading pressure of 100 Kg/cm$^2$ is applied is referred to simply as a powder resistance.

When the powder resistance of the needle-like titanium oxide particles is less than $10^5$ Ω·cm, the resistance of the undercoating layer lowers and does not work as a charge blocking layer.

For example, when is treated with a conductive treatment by using an $SnO_2$ conductive layer doped with antimony, titanium oxide shows a very low powder resistance such as $10^0$ Ω·cm or $10^1$ Ω·cm. In that case, the titanium oxide can not be used as the undercoating layer because it can not work as an electric charge blocking layer and chargeability of the photoconductor is degraded. On the other hand, if the powder resistance of the titanium oxide becomes high as $10^{10}$ Ω·cm or more to reach the same level as the volume resistance of the binder resin or more, transportation of carriers generated by exposure is controlled or prevented. This leads to an increase in residual potential, so that it is not preferred.

Besides, as long as the powder resistance of the needle-like titanium oxide particles remain within the above scope, the surface of the titanium oxide particles may remain untreated or may be coated with $Al_2O_3$, $SiO_2$, ZnO and the like or the mixture thereof for improvement in dispersion properties and surface smoothness.

The binder resin contained in the undercoating layer may be formed of the same materials as that of the undercoating layer formed as a single resin layer. Among them, polyamide resin is preferably used because it satisfies various conditions required of the binder resin such as (i) polyamide resin is neither dissolved nor swollen in a solution used for forming the photosensitive layer on the undercoating layer, and (ii) polyamide resin has an excellent adhesiveness with a conductive support as well as flexibility. In the polyamide resin, alcohol soluble nylon resin is most preferable, for example, copolymer nylon polymerized with 6-nylon, 6,6-nylon, 610-nylon, 11-nylon, 12-nylon and the like; and nylon which is chemically denatured such as N-alkoxy methyl denatured nylon and N-alkoxy ethyl denatured nylon.

The undercoating layer is formed by preparing a mixture solvent comprising the lower alcohol and the organic solvent described above which preferably is an azeotropic solvent; dispersing the polyamide resin and titanium oxide particles in the mixture solvent to form a coating solution for the undercoating layer; coating the conductive support with the coating solution and drying it. The organic solvent is combined for improving dispersion in the alcohol solvent and preventing the coating solution from gelation with the elapse of time. Further, the azeotropic solvent is used for preventing the composition of the coating solution from being changed as the time passes, whereby storage stability of the coating solution can be improved and the coating solution can be reproduced. The storage is represented by the number of dates counted from the date of forming the coating solution for the undercoating layer (hereinafter referred to a pot life).

The thickness of the undercoating layer is preferably in the range from 0.01 μm to 10 μm, more preferably from 0.05 μm to 5 μm.

The coating solution for the undercoating layer is dispersed by using a ball mill, sand mill, attritor, oscillating mill or ultrasonic mill etc. and is coated by a general method such as dip coating method as described above.

The conductive support used for the present invention includes a metal drum or sheet formed of aluminium, aluminium alloy, copper, zinc, stainless steel, nickel or titanium etc.; and a drum, sheet or seamless belt formed by treating the surface of a polymer material such as polyethylene terephthalate, nylon, polystyrene and the like or a hard paper laminated with metal leaf or metallizing.

The photosensitive layer formed on the undercoating layer may have a function separated structure comprising electric charge generation layer and electric charge transport layer in which function is separated or a single layer structure.

In case of function separated photoconductors, the electric charge generation layer is firstly formed on the undercoating layer. The electric charge generating substance contained in the electric charge generation layer includes bis-azo compounds such as chlorodiane blue, polycyclic quinone compounds such as dibromoanthanthrone, perylene compounds, quinacridone compounds, phthalocyanine compounds and azulenium salts, which may be used solely or in combination. The electric charge generation layer can be formed by directly forming the compound under vacuum evaporation. Alternatively, it can be formed by dispersing the charge generating substance into the binder resin solution. As a method for forming the electric charge generation layer, the latter is generally preferable. In the latter process, the steps for mixing or dispersing the electric charge generating substances into the binder resin solution and coating are the same as that of the undercoating layer. The binder resin of the present invention may be a conventional resin which is used solely or in combination. Preferably, melamine resins, epoxy resins, silicon resins, polyurethane resins, acryl resins, polycarbonate resins, polyarylate resins, phenoxy resins, and copolymer resins formed of two or more repeating units described above are used. As the copolymer, an insulating resin such as vinyl chloride-vinyl acetate copolymer resin, acrylonitrile-styrene copolymer may be used.

The solvent used for dissolving these resins includes haligenated hydrocarbons such as methylene chloride and dichloroethane; ketones such as acetone, methylethylketone and cyclohexanone; esters such as ethyl acetate and butyl acetate; ethers such as tetrahydrofuran and dioxane; aromatic hydrocarbons such as benzene, toluene and xylene; nonprotonic polar solvents such as N,N-dimethylformamide, N,N-dimethylacetamide and dimethylformamide. The thickness of the electric charge generation layer is preferably in the range from 0.05 μm to 5 μm, more preferably from 0.1 μm to 1 μm.

The electric charge transporting substances contained in the electric charge transport layer formed on the electric charge generation layer includes hydrazone compounds, pyrazoline compounds, triphenylamine compounds, triphenylmethane compounds, stilbene compounds, oxadiazole compounds and the like. The coating solution for the electric charge transport layer is formed by dissolving the electric charge transporting substances into the binder resin solution.

The coating step of the electric charge transporting substance is the same method as that of the undercoating layer. The thickness of the electric charge transport layer is preferably in the range from 5 μm to 50 μm, more preferably from 10 μm to 40 μm.

When the photosensitive layer is formed of a single structure, the thickness of the photosensitive layer is preferably in the range from 5 μm to 50 μm, more preferably from 10 μm to 40 μm.

Since the undercoating layer works as a barrier against implantation of carrier from the conductive support and has a high sensitivity and durability irrespective of the structural type, negative photosensitive layer is preferable.

For the purpose of improving the sensitivity, lowering the residual potential and preventing fatigue after repeated use, at least one type of electron acceptor can be added to the photoconductor. Examples of the electron acceptor include quinone compounds such as para-benzoquinone, chloranil, tetrachloro 1,2-benzoquinone, hydroquinone, 2,6-dimehylbenzoquinone, methyl 1,4-benzoquinone, α-naphthoquinone and β-naphthoquinone; nitro compounds such as 2,4,7-trinitro-9-fluorenone, 1,3,6,8-tetranitrocarbazole, p-nitro benzophenone, 2,4,5,7-tetranitro-9-fluorenone and 2-nitrofluorenone; and cyano compounds such as tetracyanoethylene, 7,7,8,8-tetracyanoquinodimethane, 4 -(p-nitrobenzoyloxy)-2',2'-dicyanovinylbenzene, 4-(m-nitrobenzoyloxy)-2',2'-dicyanovinylbenzene. Among them, fluorenone compounds, quinone compounds and benzene derivatives containing an electron-withdrawing substituent such Cl, CN and $NO_2$ are most preferable. The photosensitive layer may further contain an UV absorber or antioxidant such as benzoic acid, stilbene compounds and derivatives thereof and nitrogen containing compounds such as triazole compounds, imidazole compounds, oxadiazole compounds, thiazole compounds and derivatives thereof.

Further, if necessary, a protective layer may be formed on the photosensitive layer to protect the surface. As the protective layer, thermoplastic resin, photosetting or thermosetting resin may be used. The protective layer may contain the UV absorber or antioxidant; inorganic material such as metal oxide; organic metal compound; electron acceptor substance and the like. In addition, plasticizer such as dibasic ester, fatty acid ester, phosphoric ester, phthalic acid ester and chlorinated paraffin may be added to add processing ability and plasticity and to improve the physical properties, if it is necessary. Further, a levelling agent such as silicon resin may be used.

Since the particle of the needle-like titanium oxide has a long and narrow shape, the particles are easily in contact with each other and the contact area between the particles is greater than that of the grain-like particles. Therefore, even if the content of the titanium oxide in the undercoating layer is smaller than the grain-like particles, the undercoating layer having an equivalent properties can be easily produced. Employing a reduced amount of titanium oxide is advantageous for improving the film strength and adhesive properties with the conductive support. The properties of the photoconductor containing the needle-like titanium oxide particles are not degraded after repeated use because the contact between the particles thereof are strong, whereby excellent stability is obtained.

When two undercoating layers are provided one of which contains the needle-like titanium oxide particles and the other contains the grain-like titanium oxide particles with the same content, the undercoating layer containing the needle-like titanium oxide particles have smaller resistance than the undercoating layer containing the grain-like titanium oxide particles is smaller than that of the grain-like titanium oxide particles. This allows forming the undercoating layer containing the needle-like titanium oxide particles thicker than that of containing the grain-like one. As a result, the surface defect of the conductive support hardly appears on the surface of the undercoating layer containing the needle-like titanium oxide, which means the needle-like titanium oxide is favorable in obtaining a smooth surface of the undercoating layer.

Additionally, the undercoating layer containing the needle-like particles, even without any particular surface treatment, exhibit a very stable dispersion properties with respect to a mixed solvent of a lower alcohol used for coating solution for the undercoating layer and other organic solvents or a mixed solvent comprising an azeotropic composition thereof, so that the stability can be maintained over a long period and the surface of the support can be coated evenly. As a result, a uniform and favorable image properties can be obtained.

Examples

The present invention will be detailed in accordance with drawings illustrating examples, but it is not limited to them. In the examples is employed a function-separated type electrophotographic photoconductor. However, the similar effects can be obtained using a single-layer structure electrophotographic photoconductor.

EXAMPLES 1 to 5

FIG. 2 is a sectional view schematically illustrating a function-separated type electrophotographic photoconductor of Examples in accordance with the present invention. The electrophotographic photoconductor comprises an undercoating layer 2 formed on a conductive support 1 and a photosensitive layer 5 formed on the undercoating layer. The photosensitive layer comprises an electric charge generation layer 3 containing an electric charge generation substance 30 and an electric charge transport layer 4 containing an electric charge transport substance 40.

To a mixed solvent comprising 28.7 parts by weight of methyl alcohol and 53.3 parts by weight of 1,2-dichloroethane were mixed 1.8 parts by weight of STR-60N (manufactured by Sakai Chemical Industry Co., Ltd.) not applied with surface treatment and having a powder resistance of about $9\times10^5$ Ω·cm, length of longitudinal axis L=0.05 μm, length of short axis S=0.01 μm and aspect ratio 5, as needle-like titanium oxide, and 16.2 parts by weight of copolymer nylon resin (manufactured by Toray Industries, Inc.: CM8000) as binder resin. The mixture was dispersed for 8 hours by a paint shaker to form a coating solution for the undercoating layer. The coating solution thus formed was coated on an aluminum-made conductive support having a thickness of 100 μm as a conductive support 1 with a baker applicator, followed by drying the coated support with hot air for 10 minutes at 110° C. to provide the undercoating layer 2 having a dried thickness of 3.0 μm. When the coating solution is dried, the solvent is evaporated and the needle-like titanium oxide and the copolymer nylon resin are left as the undercoating layer to set the content of the needle-like titanium oxide 10 wt %.

In addition, 1.5 parts by weight of a bis-azo pigment (chlorodiane blue) having the following chemical formula 1 and 1.5 parts by weight of phenoxy resin (manufactured by Union Carbide: PKHH) were mixed to 97 parts by weight of 1,2-dimethoxyethane, followed by being dispersed for 8 hours with the paint shaker to form the coating solution for electric charge generation layer. This coating solution for the electric charge generation layer was coated on the undercoating layer 2 with the baker applicator. Then, the coating solution was dried with hot air for 10 minutes at a 90° C. to provide the electric charge generation layer 3 having a dried thickness of 0.8 μm.

Further, 1 part by weight of a hydrazone compound of the chemical formula 2, 0.5 part by weight of a polycarbonate resin (manufactured by Mitsubishi Gas Chemical Company, Ltd.: Z-200) and 0.5 parts by weight of polyarylate resin (manufactured by Unichika: U-100) were mixed to 8 parts by weight of dichloromethane, followed by stirring and dissolving the mixture with a magnetic stirrer to form a coating solution for the electric charge transport layer. This coating solution for the electric charge transport layer was coated on the electric charge generation layer 3 with a baker applicator. This coating solution was dried with hot air for 1 hour at 80° C. to provide the electric charge transport layer 4 having a dried thickness of 20 μm, thereby forming a function-separated type electrophotographic photoconductor shown in FIG. 2.

Chemical formula 1

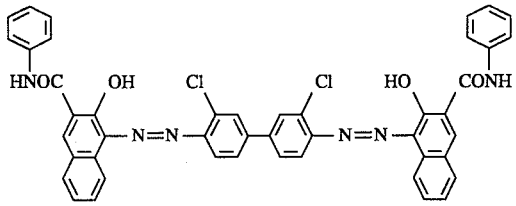

Chemical formula 2

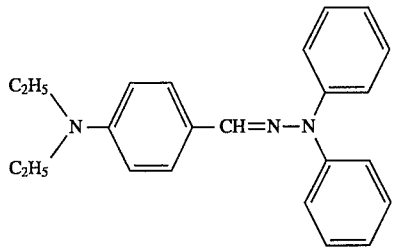

Thus the electrophotographic photoconductor was loaded on an actual device (manufactured by Sharp Kabushiki Kaisha: SF-8870) to measure a surface potential of the photoconductor at a developing section, for example, a surface potential of the photoconductor ($V_O$) in darkness except for the exposing process to examine the charging capabilities, the surface potential after discharge ($V_R$) and a surface potential of the photoconductor ($V_L$) at a blank portion when exposed to examine sensitivity. These photoconductive properties were measured at the initial point and after 20000 times repetitive use in the following conditions: low temperature/low humidity of 5° C./20% RH (hereinafter abbreviated as "L/L"), normal temperature/normal humidity of 25° C./60% RH (hereinafter abbreviated as "N/N") and high temperature/high humidity of 35° C./85% RH (hereinafter abbreviated as "H/H"). Example 1 of Table 1 shows the results of the measurements.

Examples 2 to 5 of the electrophotographic photoconductor were formed in the same manner as Example 1 except that the mixing rate of the needle-like titanium oxide and the copolymer nylon resin was varied so that the content of the titanium oxide was 50, 80, 95 and 99 wt % to provide an undercoating layer, thereby measuring the photoconductive properties. The results of the measurements are shown in Examples 2 to 5 of Table 1 in the same manner.

EXAMPLES 6 TO 10

Examples 6 to 10 of the electrophotographic photoconductor were formed using the same STR-60N (manufactured by Sakai Chemical Industry Co., Ltd.) as Examples 1 to 5, using N-methoxymethyl nylon resin (manufactured by Teikoku Chemical Industry Co., Ltd.) as binder resin in an undercoating layer and by varying the mixing rate of N-methoxymethyl nylon resin in the same manner as Examples 1 to 5 to provide the undercoating layer, thereby measuring the photoconductive properties. Table 1 shows the results of the measurements.

The results shown in Table 1 allow providing a photoconductor favorable in photoconductive properties within the scope of 10 to 99 wt % of the content of the needle-like titanium oxide to which surface treatment is not applied and having an aspect ratio of 5, and excellent in repetitive stability in each environment.

EXAMPLES 11 TO 15

Examples 11 to 15 of the electrophotographic photoconductor were formed using FTL-100 (manufactured by Ishihara Sangyo Kaisha, Ltd.), as needle-like titanium oxide, to which surface treatment is not applied and having a powder resistance of about $3\times10^5$ Ω·cm, L=3 to 6 μm, S=0.05 to 0.1 μm and an aspect ratio of 30 to 120, using copolymer nylon resin (manufactured by Toray Industries, Inc.: CM8000) as binder resin in an undercoating layer and by varying the mixing rate in the same manner as Examples 1 to 5 to provide the undercoating layer, thereby measuring the photoconductive properties. Table 2 shows the results of the measurements.

EXAMPLES 16 TO 20

Examples 16 to 20 of the electrophotographic photoconductor were formed using the same FTL-100 (manufactured by Ishihara Sangyo Kaisha, Ltd.) as Examples 11 to 15, using N-methoxymethyl nylon resin (manufactured by Teikoku Chemical Industry Co., Ltd.: EF-30T) as binder resin in an undercoating layer and by varying the mixing rate in the same manner as Examples 1 to 5 to provide the undercoating layer, thereby measuring the photoconductive properties. Table 2 shows the results of the measurements.

The results shown in Table 2 allow providing a photoconductor favorable in photoconductive properties within the scope of 10 to 99 wt % of the content of the needle-like titanium oxide to which surface treatment is not applied and having an aspect ratio of 30 to 120, and excellent in repetitive stability in each environment.

EXAMPLES 21 TO 25

Examples 21 to 25 of the electrophotographic photoconductor were formed using STR-60 (manufactured by Sakai Chemical Industry Co., Ltd.), as needle-like titanium oxide, coated with $Al_2O_3$ and having a powder resistance of about $4\times10^6$ Ω·cm, L=0.05 μm, S=0.01 μm and an aspect ratio of 5, using copolymer nylon resin (manufactured by Toray Industries, Inc.: CM8000) as binder resin in an undercoating layer and by varying the mixing rate in the same manner as Examples 1 to 5 to provide the undercoating layer, thereby measuring the photoconductive properties. Table 3 shows the results of the measurements.

EXAMPLES 26 TO 30

Examples 26 to 30 of the electrophotographic photoconductor were formed using the same STR-60 (manufactured by Sakai Chemical Industry Co., Ltd.) as Examples 21 to 25, as needle-like titanium oxide, using N-methoxymethyl nylon resin (manufactured by Teikoku Chemical Industry Co., Ltd.: EF-30T) as binder resin in an undercoating layer and by varying the mixing rate in the same manner as Examples 1 to 5 to provide the undercoating layer, thereby measuring the photoconductive properties. Table 3 shows the results of the measurements.

The results shown in Table 3 allow providing a photoconductor favorable in photoconductive properties within the scope of 10 to 99 wt % of the content of the needle-like titanium oxide coated with $Al_2O_3$ and having an aspect ratio of 5, and excellent in repetitive stability in each environment.

Comparative Examples 1 to 5

Comparative Examples 1 to 5 of the electrophotographic photoconductor were formed using TTO-55N (manufactured by Ishihara Sangyo Kaisha, Ltd.), as grain-like titanium oxide, to which surface treatment is not applied and having a powder resistance of about $5\times10^5$ Ω·cm and an average particle diameter of 0.03 μm, using copolymer nylon resin (manufactured by Toray Industries, Inc.: CM8000) as binder resin in an undercoating layer and by varying the mixing rate in the same manner as Examples 1 to 5 to provide the undercoating layer, thereby measuring the photoconductive properties. Table 4 shows the results of the measurements.

Comparative Examples 6 to 10

Comparative Examples 6 to 10 of the electrophotographic photoconductor were formed using the same TTO-55N (manufactured by Ishihara Sangyo Kaisha, Ltd.) as Comparative Examples 1 to 5, as grain-like titanium oxide, using N-methoxymethyl nylon resin (manufactured by Teikoku Chemical Industry Co., Ltd.: EF-30T) as binder resin in an undercoating layer and by varying the mixing rate in the same manner as Examples 1 to 5 to provide the undercoating layer, thereby measuring the photoconductive properties. Table 4 shows the results of the measurements.

The results shown in Table 4 indicate that in use of grain-like titanium oxide to which surface treatment is not applied, residual potential $V_R$ is stored in large quantity and sensitivity $V_L$ is greatly degrated after 20000 times repetitive use when the content of the titanium oxide is 10 and 50 wt %. With the increase of the content of the titianium oxide, deterioration of the photoconductive properties is improved. When the content is 95 and 99 wt %, the electrophotographic photoconductor exhibits relatively favorable photoconductive properties in the environmental conditions of N/N and H/H. However, after 20000 times repetitive use in the environmental condition of L/L, the residual potential $V_R$ is stored in large quantity and the sensitivity $V_L$ is degraded.

Comparative Examples 11 to 15

Comparative Examples 11 to 15 of the electrophotographic photoconductors were formed using TTO-55A (manufactured by Ishihara Sangyo Kaisha, Ltd.), as grain-like titanium oxide, coated with $Al_2O_3$ and having a powder resistance of about $4\times10^7$ Ω·cm and an average particle diameter of 0.03 μm, using copolymer nylon resin (manufactured by Toray. Industries, Inc.: CM8000) as binder resin in an undercoating layer and by varying the mixing rate in the same manner as Examples 1 to 5 to provide the undercoating layer, thereby measuring the photoconductive properties. Table 5 shows the results of the measurements.

Comparative Examples 16 to 20

Comparative Examples 16 to 20 of the electrophotographic photoconductor were formed using the same TTO-55A (manufactured by Ishihara Sangyo Kaisha, Ltd.) as Comparative Examples 11 to 15, as grain-like titanium oxide, using N-methoxymethyl nylon resin (manufactured by Teikoku Chemical Industry Co., Ltd.: EF-30T) as binder resin in an undercoating layer and by varying the mixing rate in the same manner as Examples 1 to 5 to provide the undercoating layer, thereby measuring the photoconductive properties. Table 5 shows the results of the measurements.

The results shown in Table 5 indicate that in use of non-conductive, grain-like titanium oxide coated with $Al_2O_3$, the residual potential $V_R$ is stored in large quantity and the sensitivity $V_L$ is greatly degraded after 20000 times repetitive use when the content of the titanium oxide is 10 and 50 wt %. With the increase of the content of the titanium oxide, deterioration of the photoconductive properties is improved. When the content is 95 and 99 wt %, the electrophotographic photoconductor exhibits relatively favorable photoconductive properties in the environmental conditions of N/N and H/H. However, after 20000 times repetitive use in the environmental condition of L/L, the residual potential $V_R$ is stored in large quantity and the sensitivity $V_L$ is degraded.

Comparative Examples 21 to 25

Comparative Examples 21 to 25 of the electrophotographic photoconductor were formed using FTL-1000 (manufactured by Ishihara Sangyo Kaisha, Ltd.), as needle-like titanium oxide, of which surface is rendered to be conductive by being treated with $SnO_2$ (doped with antimony) and having a powder resistance of about $1\times10^1$ Ω·cm, L=3 to 6 μm, S=0.05 to 0.1 μm and an aspect ratio of 30 to 120, using copolymer nylon resin (manufactured by Toray Industries, Inc.: CM8000) as binder resin in an undercoating layer and by varying the mixing rate in the same manner as Examples 1 to 5 to provide the undercoating layer, thereby measuring the photoconductive properties. Table 6 shows the results of the measurements.

Comparative Examples 26 to 30

Comparative Examples 26 to 30 of the electrophotographic photoconductor were formed using the same FTL-1000 (manufactured by Ishihara Sangyo Kaisha, Ltd.) as Comparative Examples 21 to 25, as needle-like titanium oxide, using N-methoxymethyl nylon resin (manufactured by Teikoku Chemical Industry Co., Ltd.: EF-30T) as binder resin in an undercoating layer and by varying the mixing rate in the same manner as Examples 1 to 5 to provide the undercoating layer, thereby measuring the photoconductive properties. Table 6 shows the results of the measurements.

The results shown in Table 6 indicate that in use of needle-like titanium oxide applied with conductive threatment, with the increase of the content of the titanium oxide, charging properties $V_O$ is degraded and further, after 20000 times repetitive use, extremely deteriorated to the level that the electrophotographic photoconductor is hardly charged.

EXAMPLE 31

Example 31 of the function-separated electrophotographic photoconductor was formed in the same manner as in Example 1 except that with a dip coating device as shown in FIG. 1, a coating solution for an undercoating layer having a dried thickness of 3.0 μm, prepared using 17.1 parts by weight of needle-like titanium oxide and 0.9 parts by weight of copolymer nylon resin as binder resin was dip coated on an aluminum-made drum-like conductive support having a size of 1 mm(t)×80 mm(ϕ)×348 mm and a maximum surface roughness of 0.5 μm, which was then dip coated with a coating solution for an electric charge generation layer and that for electric charge transport layer. The conductive support thus coated was loaded on an actual device (manufactured by Sharp Kabushiki Kaisha: SF-8870) to perform an image evaluation. Table 7 shows the result of the evaluation.

EXAMPLES 32 TO 35

Examples 32 to 35 of the electrophotographic photoconductor were formed in the same manner as in Example 31 except that 1,2-dichloroethane which is the organic solvent of the coating solution for the undercoating layer of Example 31 was replaced with 1,2-dichloropropane, chloroform, tetrahydrofuran and toluene respectively to make an azetropic composition having the mixing rate with methyl alcohol as shown in Table 7 to perform the image evaluation in the same manner as Example 31. Table 7 shows the result of the evaluation.

EXAMPLES 36 TO 40

Examples 36 to 40 of the electrophotographic photoconductors were formed in the same manner as in Examples 31 to 35 except that with the coating solution for the undercoating layer of Examples 31 to 35 the rate of the methyl alcohol and each organic solvent was set to 41:41 to perform the image evaluation in the same manner as Example 31. Table 7 shows the result of the evaluation.

Comparative Example 31

Comparative Example 31 of the electrophotographic photoconductor was formed in the same manner as Example 31 except that methyl alcohol of 82 parts by weight was singly used for the solvent of the coating solution for the undercoating layer of Example 31 to perform the image evaluation in the same manner as Example 31. Table 7 shows the result of the evaluation.

EXAMPLES 41 TO 50

Examples 41 to 50 of the electrophotographic photoconductors were formed in the same manner as Examples 31 to 40 except that the pot life in the coating solution for the undercoating layer has passed 30 days to perform the image evaluation. Table 8 shows the result of the evaluation.

Comparative Example 32

Comparative Example 32 of the electrophotographic photoconductors was formed in the same manner as Examples 31 except that the pot life in the coating solution for the undercoating layer has passed 30 days to perform the image evaluation. Table 8 shows the result of the evaluation.

EXAMPLE 51

The turbidity of the coating solution for the undercoating layer of Example 31 was measured using a turbidimeter with integrating sphere (manufactured by Mitsubishi Chemical Industries Ltd.: SEPPT-501D) to perform the evaluation in dispersibility and stability. Table 9 shows the result of the evaluation.

EXAMPLE 52

The turbidity of the coating solution for the undercoating layer used in Example 51 was measured after the pot life has passed 30 days, thereby performing the evaluation in dispersibility and stability. Table 9 shows the result of the evaluation.

EXAMPLE 53

A coating solution for the undercoating layer was formed in the same manner as Example 31 except that the solvent comprised 41 parts by weight of the ethyl alcohol and 41 parts of weight of 1,2-dichloropropane to measure the turbidity in the same manner as Example 51 to perform the evaluation in dispersibility and stability. Table 9 shows the result of the evaluation.

Example 54

The turbidity of the coating solution for the undercoating layer used in Example 53 was measured in the same manner as Example 51 except that the pot life has passed 30 days to perform the evaluation in dispersibility and stability. Table 9 shows the result of the evaluation.

Comparative Example 33

The turbidity of the coating solution for the undercoating layer of Comparative Example 31 was measured in the same manner as Example 51 to perform the evaluation in dispersibility and stability. Table 9 shows the result of the evaluation.

Comparative Example 34

The turbidity of the coating solution for the undercoating layer used in Comparative Example 32 in which the pot life has passed 30 days was measured in the same manner as Example 51 to perform the evaluation in dispersibility and stability. Table 9 shows the result of the evaluation.

Comparative Example 35

The surface-untreated, needle-like titanium oxide used for the coating solution for the undercoating layer of Example 31 was replaced with grain-like titanium oxide (manufactured by Ishihara Sangyo Kaisha, Ltd.: TTO-55N) not applied with surface treatment and having a powder resistance of $10^7$ Ω·cm and an average particle diameter of 0.03 μm. Then the turbidity was measured in the same manner as Example 51 to perform the evaluation in dispersibility and stability. Table 9 shows the result of the evaluation.

In view of the results of Examples 31 to 54, using the surface-untreated, needle-like titanium oxide and the mixed solvent in accordance with the present invention as a solvent allowed improving the dispersibility and the stability of the coating solution.

EXAMPLES 55 TO 56

Examples 55 to 56 of the electrophotographic photoconductor having an undercoating layer with a dried thickness of 1.0 μm were formed in the same manner as Examples 31 and 32 except that the coating solution for the undercoating layer was dip coated on an aluminum-made drum-like conductive support which is the same as that of Examples 31 and 32 except for having a maximum surface roughness of 0.2 μm to perform the image evaluation in the environmental conditions of L/L of 5° C./20% RH, N/N of 25° C./60% RH, H/H of 35° C./85% RH respectively at the initial point and after 20000 times repetitive use in the same manner as Example 31.

The results of Examples 55 and 56 allowed providing the excellent quality of the image free from image irregularities resulted from defects and coating irregularities caused in the conductive support in all environmental conditions. Besides, the quality of the image after 20000 times repetitive use was equally favorable to that at the initial point.

EXAMPLES 57 AND 58

Examples 57 and 58 of the electrophotographic photoconductor were formed in the same manner as Example 55 except that binder resin of the coating solution for the undercoating layer of Examples 31 and 32 was replaced with N-methoxymethyl nylon resin (manufactured by Teikoku Chemical Industry Co., Ltd.: EF-30T) to perform the image evaluation.

The results of Examples 57 and 58 allowed providing the excellent quality of the image free from image irregularities in all environmental conditions. Besides, the quality of the image after 20000 times repetitive use was equally favorable to that at the initial point.

Comparative Example 36

Comparative Example 36 of the electrophotographic photoconductor was formed in the same manner as Example 55 except that binder resin of the coating solution for the undercoating layer of Example 31 was replaced with butyral resin (manufactured by Denki Kagaku Kogyo Kabushiki Kaisha: 3000K) which is not copolymer nylon resin to perform the image evaluation.

The results of Comparative Example 36 indicated that the undercoating layer was dissolved in a solvent for an electric charge generation layer when the electric charge generation layer was dip coated to cause liquid lopping and irregularities in a coating film of the electric charge generation layer. Further image irregularities resulted from these coating irregularities were caused. In particular, the image irregularities were outstandingly exhibited after 20000 repetitive.

Comparative Example 37

Comparative Example 37 of the electrophotographic photoconductor was formed in the same manner as Example 55 except for using, as needle-like titanium oxide, FTL-1000 (manufactured by Ishihara Sangyo Kaisha, Ltd.), of which surface is rendered to be conductive by being treated with $SnO_2$ (doped with antimony), and having a powder resistance of $1\times10^1$ Ω·cm, L=3 to 6 μm, S=0.05 to 0.1 μm and an aspect ratio of 30 to 120 to perform the image evaluation.

The results of Comparative Example 37 indicated very poor charging properties and extremely degraded image tone in a solid black portion. In particular, the conspicuous eduction was caused after 20000 repetitive.

Comparative Example 38

Comparative Example 38 of the electrophotographic photoconductor was formed in the same manner as Example 55 except that titanium oxide used in the undercoating layer of Example 55 was removed and that the content of copolymer nylon resin was 18 parts by weight to perform the image evaluation.

The results of Comparative Example 38 indicated very high residual potential, extremely degraded sensitivity and an overlap of image in a white portion. In particular, the overlap of image was outstandingly caused in low temperature and low moisture conditions merely after 1000 times repetitive use.

As apparent from the above results, the dispersibility and stability of the coating solution can be improved by using a mixed solvent in accordance with the present invention as a solvent for the coating solution for the undercoating layer and the needle-like titanium oxide, thereby providing an electrophotographic photoconductor having favorable image properties free from coating irregularities.

EXAMPLES 59 TO 61

Example 59 of the function-separated electrophotographic photoconductor were formed in the same manner as Example 31 except that the needle-like titanium oxide and binder resin in the coating solution for the undercoating layer were set to 1.8 parts by weight (the content of the titanium oxide: 10 wt %) and 16.2 parts by weight respectively to perform the image evaluation in the same manner as Example 31. Example 59 in Table 10 shows the results.

Furthermore, Examples 60 and 61 of the function-separated electrophotographic photoconductor were formed in the same manner as Example 31 except that the mixing rate of the needle-like titanium oxide and binder resin in the undercoating layer was varied to set the content of the titanium oxide to 30 and 50 wt % respectively to perform the image evaluation in the same manner as Example 31. Examples 60 and 61 in Table 10 shows the results.

EXAMPLES 62 TO 64

Examples 62 to 64 of the function-separated electrophotographic photoconductor were formed in the same manner as Example 31 except that binder resin in the coating solution for the undercoating layer was replaced with N-methoxymethyl nylon resin (manufactured by Teikoku chemical Industry Co., Ltd.: EF-30T) and that in the same manner as Examples 59 to 61 the mixing rate of the needle-like titanium oxide in the undercoating layer was varied to perform the image evaluation in the same manner as Example 31. Table 10 shows the results.

Comparative Examples 39 to 41

Comparative Examples 39 to 41 of the function-separated electrophotographic photoconductor were formed in the same manner as Example 31 except that surface-untreated grain-like titanium oxide having a powder resistance of $10^7$ Ω·cm and an average particle diameter of 0.03 μm (manufactured by Ishihara Sangyo Kaisha, Ltd.: TTO-55N) and that the mixing rate of the grain-like titanium oxide in the undercoating layer was varied in the same manner as Examples 59 to 61 to perform the image evaluation in the same manner as Example 31. Table 10 shows the results.

Comparative Examples 42 to 44

Examples 42 to 44 of the function-separated electrophotographic photoconductor were formed in the same manner as Example 31 except that grain-like titanium oxide was used in the same manner as Comparative Examples 39 to 41, that N-methoxymethyl nylon resin (manufactured by Teikoku Chemical Industry Co., Ltd.: EF-30T) was used as binder resin and that the mixing rate of the grain-like titanium oxide in the undercoating layer was varied in the same manner as Examples 59 to 61 to perform the image evaluation in the same manner as Example 31. Table 10 shows the, results.

EXAMPLES 65 TO 67

Examples 65 to 67 of the function-separated electrophotographic photoconductor were formed in the same manner as Example 32 except that the mixing rate of the needle-like titanium oxide and the binder resin in the undercoating layer was varied to 10, 30 and 50 wt % respectively to perform the image evaluation in the same manner as Example 31. Table 11 shows the results.

EXAMPLES 68 TO 70

Examples 68 to 70 of the function-separated electrophotographic photoconductor were formed in the same manner as Example 32 except that N-methoxymethyl nylon resin (manufactured by Teikoku Chemical Industry Co., Ltd.: EF-30T) was used as binder resin and that in the same manner as Examples 65 to 67 the mixing rate of the needle-like titanium oxide and the binder resin in the undercoating layer was varied to perform the image evaluation in the same manner as Example 31. Table 11 shows the results.

EXAMPLES 71 TO 73

Examples 71 to 73 of the function-separated electrophotographic photoconductor were formed in the same manner as Example 31 except that the needle-like titanium oxide and binder resin used in the coating solution for the undercoating layer were set to 9 parts by weight respectively and that the solvent contained in the coating solution for the undercoating layer was made of an azetropic composition comprising 10.33 parts by weight of methyl alcohol and 71.67 parts by weight of chloroform, one comprising 25.50 parts by weight of methyl alcohol and 56.50 parts by weight of tetrahydrofuran and one comprising 58.30 parts by weight of methyl alcohol and 23.70 parts by weight of toluene respectively to perform the image evaluation in the same manner as Example 31. Table 11 shows the results.

Specific products of needle-like titanium oxide used in the present invention include, other than the above products, surface-untreated rutile type titanium oxide such as FTL-100 (L=3 to 6 μm, S=0.05 to 0.1 μm, aspect ratio 30 to 120) and FTL-200 (L=4 to 12 μm, S=0.05 to 0.15 μm, aspect ratio 27 to 240) (manufactured by Ishihara Sangyo Kaisha, Ltd.), STR-60N (L=0.05 μm, S=0.01 μm, aspect ratio 5) (manufactured by Sakai Chemical Industry Co., Ltd.), rutile type titanium oxide coated with $Al_2O_3$ such as STR-60 (L=0.05 μm, S=0.01 μm, aspect ratio 5), STR-60A (L=0.05 μm, S=0.01 μm, aspect ratio 5) surface-treated with $Al_2O_3$ and $SiO_2$ and STR-60S (L=0.05 μm, S=0.01 μm, aspect ratio 5) surface-treated with $SiO_2$ (manufactured by Sakai Chemical Industry Co., Ltd.)

Besides, specific products of binder resin include, other than the above products, CM4000 (manufactured by Toray Industries, Inc.), F-30 and MF-30 (manufactured by Teikoku Chemical Industry Co., Ltd.) The present invention allows providing an electrophotographic photoconductor which has high sensitivity and a prolonged life with favorable image properties free from coating irregularities, by providing the undercoating layer using a coating solution which is a mixed solvent, preferably a mixed solvent of an azetropic composition of lower alcohol selected from a group comprising methyl alcohol, ethyl alcohol, isopropyl alcohol and n-propyl alcohol, and an organic solvent selected-from a group comprising dichloromethane, chloroform, 1,2-dichloroethane, 1,2-dichloropropane, toluene and tetrahydrofuran, when the undercoating layer cotains surface-untreated needle-like titanium oxide fine particles.

TABLE 1

| | $TiO_2$ | | binder | | initial value (−V) | | | after 20000 cycle (−V) | | |
|---|---|---|---|---|---|---|---|---|---|---|
| Example | type | W % | resin | environment | $V_O$ | $V_R$ | $V_L$ | $V_O$ | $V_R$ | $V_L$ |
| 1 | A | 10 | a | L/L | 702 | 21 | 148 | 705 | 32 | 156 |
| | | | | N/N | 710 | 14 | 143 | 714 | 20 | 148 |
| | | | | H/H | 710 | 13 | 142 | 715 | 18 | 147 |
| 2 | A | 50 | a | L/L | 705 | 16 | 144 | 712 | 27 | 154 |
| | | | | N/N | 709 | 12 | 143 | 713 | 16 | 146 |
| | | | | H/H | 711 | 11 | 142 | 710 | 14 | 145 |
| 3 | A | 80 | a | L/L | 705 | 12 | 143 | 707 | 17 | 147 |
| | | | | N/N | 707 | 10 | 142 | 708 | 11 | 144 |
| | | | | H/H | 706 | 10 | 142 | 707 | 11 | 143 |
| 4 | A | 95 | a | L/L | 704 | 9 | 139 | 702 | 8 | 138 |
| | | | | N/N | 704 | 8 | 139 | 705 | 9 | 139 |
| | | | | H/H | 703 | 7 | 138 | 702 | 7 | 138 |
| 5 | A | 99 | a | L/L | 700 | 9 | 138 | 696 | 7 | 134 |
| | | | | N/N | 702 | 9 | 138 | 700 | 8 | 135 |
| | | | | H/H | 703 | 8 | 137 | 704 | 9 | 138 |
| 6 | A | 10 | b | L/L | 703 | 20 | 148 | 705 | 33 | 156 |
| | | | | N/N | 709 | 14 | 142 | 713 | 19 | 147 |
| | | | | H/H | 710 | 12 | 142 | 716 | 19 | 148 |
| 7 | A | 50 | b | L/L | 709 | 12 | 142 | 715 | 25 | 156 |
| | | | | N/N | 712 | 11 | 143 | 713 | 15 | 146 |
| | | | | H/H | 709 | 10 | 141 | 710 | 14 | 144 |
| 8 | A | 80 | b | L/L | 704 | 10 | 140 | 712 | 16 | 147 |
| | | | | N/N | 706 | 8 | 139 | 707 | 10 | 141 |
| | | | | H/H | 705 | 8 | 138 | 707 | 11 | 140 |
| 9 | A | 95 | b | L/L | 702 | 8 | 138 | 700 | 7 | 138 |
| | | | | N/N | 703 | 7 | 138 | 704 | 7 | 139 |
| | | | | H/H | 701 | 7 | 136 | 703 | 8 | 138 |
| 10 | A | 99 | b | L/L | 699 | 7 | 136 | 694 | 5 | 132 |
| | | | | N/N | 701 | 7 | 137 | 698 | 6 | 136 |
| | | | | H/H | 702 | 6 | 137 | 699 | 6 | 137 |

$TiO_2$

A — manufactured by Sakai Chemical Industry Co., Ltd.: STR-60N, needle-like, not applied with surface tretment, 0.05 × 0.01 μm binder resin a — copolymer resin, manufactured by Toray Industries, Inc.: CM-8000 b — N-methoxymethyl nylon, manufactured by Teikoku Chemical Industry Co., Ltd.: EF-30T

TABLE 2

| Example. | $TiO_2$ type | $TiO_2$ W % | binder resin | environment | initial value (−V) $V_O$ | initial value (−V) $V_R$ | initial value (−V) $V_L$ | after 20000 cycle (−V) $V_O$ | after 20000 cycle (−V) $V_R$ | after 20000 cycle (−V) $V_L$ |
|---|---|---|---|---|---|---|---|---|---|---|
| 11 | B | 10 | a | L/L | 705 | 24 | 150 | 713 | 35 | 159 |
| | | | | N/N | 712 | 16 | 144 | 716 | 22 | 149 |
| | | | | H/H | 711 | 13 | 142 | 714 | 20 | 148 |
| 12 | B | 50 | a | L/L | 706 | 19 | 146 | 714 | 29 | 153 |
| | | | | N/N | 709 | 14 | 145 | 716 | 19 | 147 |
| | | | | H/H | 710 | 12 | 142 | 713 | 15 | 145 |
| 13 | B | 80 | a | L/L | 704 | 11 | 143 | 709 | 18 | 147 |
| | | | | N/N | 706 | 10 | 142 | 707 | 12 | 144 |
| | | | | H/H | 704 | 10 | 141 | 706 | 11 | 142 |
| 14 | B | 95 | a | L/L | 702 | 9 | 140 | 700 | 8 | 139 |
| | | | | N/N | 701 | 8 | 139 | 703 | 8 | 139 |
| | | | | H/H | 700 | 8 | 139 | 701 | 9 | 140 |
| 15 | B | 99 | a | L/L | 698 | 8 | 135 | 696 | 7 | 134 |
| | | | | N/N | 701 | 8 | 138 | 703 | 8 | 136 |
| | | | | H/H | 700 | 7 | 137 | 701 | 8 | 137 |
| 16 | B | 10 | b | L/L | 707 | 25 | 150 | 711 | 33 | 157 |
| | | | | N/N | 706 | 15 | 144 | 714 | 20 | 151 |
| | | | | H/H | 707 | 13 | 142 | 712 | 19 | 149 |
| 17 | B | 50 | b | L/L | 706 | 18 | 147 | 715 | 29 | 154 |
| | | | | N/N | 712 | 14 | 143 | 716 | 20 | 146 |
| | | | | H/H | 706 | 11 | 142 | 712 | 14 | 145 |
| 18 | B | 80 | b | L/L | 704 | 13 | 144 | 710 | 19 | 148 |
| | | | | N/N | 707 | 11 | 143 | 711 | 13 | 145 |
| | | | | H/H | 704 | 9 | 140 | 706 | 12 | 142 |
| 19 | B | 95 | b | L/L | 701 | 10 | 141 | 701 | 9 | 140 |
| | | | | N/N | 703 | 8 | 139 | 704 | 8 | 141 |
| | | | | H/H | 705 | 8 | 140 | 706 | 8 | 141 |
| 20 | B | 99 | b | L/L | 699 | 9 | 136 | 697 | 7 | 134 |
| | | | | N/N | 701 | 8 | 136 | 703 | 8 | 136 |
| | | | | H/H | 703 | 7 | 135 | 704 | 7 | 136 |

$TiO_2$
B — manufactured by Ishihara Sangyo Kaisha, Ltd.: FTL-100, needle-like, not applied with surface treatment, 3 to 6 × 0.05 to 0.1 μm
binder resin
a — copolymer resin, manufactured by Toray Industries, Inc.: CM-8000
b — N-methoxymethyl nylon, manufactured by Teikoku Chemical Industrys Co., Ltd.: EF-30T

TABLE 3

| Example | $TiO_2$ type | $TiO_2$ W % | binder resin | environment | initial value (−V) $V_O$ | initial value (−V) $V_R$ | initial value (−V) $V_L$ | after 20000 cycle (−V) $V_O$ | after 20000 cycle (−V) $V_R$ | after 20000 cycle (−V) $V_L$ |
|---|---|---|---|---|---|---|---|---|---|---|
| 21 | C | 10 | a | L/L | 701 | 20 | 147 | 703 | 30 | 154 |
| | | | | N/N | 710 | 13 | 142 | 713 | 20 | 149 |
| | | | | H/H | 709 | 13 | 142 | 715 | 17 | 146 |
| 22 | C | 50 | a | L/L | 706 | 15 | 144 | 714 | 24 | 150 |
| | | | | N/N | 712 | 10 | 141 | 715 | 14 | 145 |
| | | | | H/H | 710 | 10 | 142 | 714 | 13 | 144 |
| 23 | C | 80 | a | L/L | 705 | 13 | 143 | 708 | 17 | 146 |
| | | | | N/N | 707 | 9 | 142 | 709 | 12 | 145 |
| | | | | H/H | 708 | 9 | 141 | 710 | 12 | 144 |
| 24 | C | 95 | a | L/L | 704 | 10 | 139 | 701 | 9 | 139 |
| | | | | N/N | 705 | 8 | 140 | 703 | 9 | 140 |
| | | | | H/H | 703 | 8 | 139 | 702 | 8 | 138 |
| 25 | C | 99 | a | L/L | 701 | 10 | 138 | 698 | 8 | 136 |
| | | | | N/N | 705 | 8 | 140 | 700 | 7 | 139 |
| | | | | H/H | 704 | 7 | 139 | 705 | 7 | 140 |
| 26 | C | 10 | b | L/L | 703 | 19 | 146 | 709 | 27 | 152 |
| | | | | N/N | 712 | 12 | 144 | 716 | 19 | 148 |
| | | | | H/H | 710 | 11 | 143 | 714 | 14 | 145 |
| 27 | C | 50 | b | L/L | 706 | 11 | 143 | 714 | 19 | 148 |
| | | | | N/N | 709 | 10 | 142 | 712 | 13 | 143 |
| | | | | H/H | 709 | 10 | 141 | 711 | 12 | 142 |
| 28 | C | 80 | b | L/L | 704 | 11 | 137 | 707 | 15 | 143 |
| | | | | N/N | 707 | 10 | 143 | 710 | 13 | 146 |
| | | | | H/H | 706 | 9 | 140 | 707 | 11 | 141 |

TABLE 3-continued

| Example | $TiO_2$ type | $TiO_2$ W % | binder resin | environment | initial value (–V) $V_O$ | $V_R$ | $V_L$ | after 20000 cycle (–V) $V_O$ | $V_R$ | $V_L$ |
|---|---|---|---|---|---|---|---|---|---|---|
| 29 | C | 95 | b | L/L | 703 | 10 | 139 | 701 | 9 | 139 |
| | | | | N/N | 706 | 9 | 140 | 702 | 9 | 139 |
| | | | | H/H | 704 | 7 | 138 | 705 | 8 | 138 |
| 30 | C | 99 | b | L/L | 700 | 10 | 138 | 697 | 7 | 136 |
| | | | | N/N | 705 | 8 | 139 | 701 | 6 | 137 |
| | | | | H/H | 704 | 7 | 139 | 704 | 7 | 140 |

$TiO_2$
C — manufactured by Sakai Chemical Industry Co., Ltd.: STR-60, needle-like, coated with $Al_2O_3$, 0.05 × 0.01 μm
binder resin
a — copolymer resin, manufactured by Toray Industries, Inc.: CM-8000
b — N-methoxymethyl nylon, manufactured by Teikoku Chemical Industry Co., Ltd.: EF-30

TABLE 4

| Comp. Ex. | $TiO_2$ type | $TiO_2$ W % | binder resin | environment | initial value (–V) $V_O$ | $V_R$ | $V_L$ | after 20000 cycle (–V) $V_O$ | $V_R$ | $V_L$ |
|---|---|---|---|---|---|---|---|---|---|---|
| 1 | D | 10 | a | L/L | 715 | 98 | 216 | 833 | 362 | 479 |
| | | | | N/N | 712 | 19 | 152 | 751 | 63 | 197 |
| | | | | H/H | 709 | 17 | 150 | 714 | 25 | 157 |
| 2 | D | 50 | a | L/L | 707 | 67 | 214 | 815 | 241 | 391 |
| | | | | N/N | 709 | 19 | 156 | 737 | 50 | 187 |
| | | | | H/H | 711 | 19 | 146 | 713 | 23 | 148 |
| 3 | D | 80 | a | L/L | 705 | 19 | 153 | 798 | 126 | 256 |
| | | | | N/N | 708 | 12 | 144 | 712 | 18 | 150 |
| | | | | H/H | 712 | 11 | 141 | 715 | 13 | 142 |
| 4 | D | 95 | a | L/L | 705 | 16 | 148 | 769 | 84 | 220 |
| | | | | N/N | 707 | 10 | 143 | 713 | 15 | 149 |
| | | | | H/H | 706 | 10 | 142 | 708 | 13 | 144 |
| 5 | D | 99 | a | L/L | 703 | 16 | 147 | 749 | 60 | 199 |
| | | | | N/N | 706 | 10 | 142 | 708 | 11 | 143 |
| | | | | H/H | 705 | 8 | 140 | 706 | 10 | 141 |
| 6 | D | 10 | b | L/L | 718 | 89 | 212 | 811 | 302 | 434 |
| | | | | N/N | 714 | 19 | 153 | 754 | 60 | 191 |
| | | | | H/H | 715 | 18 | 151 | 717 | 21 | 152 |
| 7 | D | 50 | b | L/L | 710 | 66 | 209 | 809 | 226 | 371 |
| | | | | N/N | 709 | 18 | 157 | 733 | 41 | 179 |
| | | | | H/H | 712 | 17 | 145 | 716 | 24 | 152 |
| 8 | D | 80 | b | L/L | 703 | 19 | 154 | 789 | 122 | 251 |
| | | | | N/N | 709 | 12 | 143 | 711 | 16 | 145 |
| | | | | H/H | 711 | 10 | 142 | 713 | 12 | 143 |
| 9 | D | 95 | b | L/L | 709 | 21 | 157 | 771 | 83 | 216 |
| | | | | N/N | 706 | 12 | 144 | 708 | 15 | 145 |
| | | | | H/H | 705 | 12 | 143 | 706 | 14 | 142 |
| 10 | D | 99 | b | L/L | 706 | 15 | 148 | 754 | 61 | 195 |
| | | | | N/N | 703 | 8 | 140 | 704 | 11 | 142 |
| | | | | H/H | 702 | 9 | 140 | 703 | 10 | 140 |

$TiO_2$
D — manufactured by Ishihara Sangyo Kaisha, Ltd.: TTO-55N, grain-like, not applied surface treatment, 0.03 μm
binder resin
a — copolymer resin, manufactured by Toray Industries, Inc.: CM-8000
b — N-methoxymethyl nylon, manufactured by Teikoku Chemical Industry Co., Ltd.: EF-30T

TABLE 5

| Comp. Ex. | $TiO_2$ W % | 樹脂 | binder resin | environment | initial value (–V) $V_O$ | $V_R$ | $V_L$ | after 20000 cycle (–V) $V_O$ | $V_R$ | $V_L$ |
|---|---|---|---|---|---|---|---|---|---|---|
| 11 | E | 10 | a | L/L | 712 | 104 | 224 | 821 | 354 | 482 |
| | | | | N/N | 714 | 21 | 153 | 740 | 59 | 198 |

TABLE 5-continued

| Comp. | $TiO_2$ | | binder | | initial value (−V) | | | after 20000 cycle (−V) | | |
|---|---|---|---|---|---|---|---|---|---|---|
| Ex. | W % | 樹脂 | resin | environment | $V_O$ | $V_R$ | $V_L$ | $V_O$ | $V_R$ | $V_L$ |
| | | | | H/H | 713 | 19 | 154 | 715 | 23 | 157 |
| 12 | E | 50 | a | L/L | 709 | 70 | 213 | 804 | 224 | 369 |
| | | | | N/N | 708 | 19 | 155 | 741 | 51 | 187 |
| | | | | H/H | 712 | 18 | 147 | 718 | 24 | 152 |
| 13 | E | 80 | a | L/L | 708 | 19 | 156 | 783 | 129 | 261 |
| | | | | N/N | 707 | 12 | 143 | 713 | 17 | 149 |
| | | | | H/H | 710 | 10 | 141 | 715 | 12 | 143 |
| 14 | E | 95 | a | L/L | 706 | 18 | 154 | 775 | 86 | 221 |
| | | | | N/N | 708 | 11 | 143 | 707 | 16 | 150 |
| | | | | H/H | 706 | 10 | 142 | 708 | 13 | 144 |
| 15 | E | 99 | a | L/L | 702 | 15 | 147 | 750 | 61 | 203 |
| | | | | N/N | 705 | 9 | 142 | 704 | 12 | 144 |
| | | | | H/H | 704 | 8 | 140 | 702 | 10 | 142 |
| 16 | E | 10 | b | L/L | 716 | 84 | 226 | 789 | 261 | 408 |
| | | | | N/N | 715 | 17 | 146 | 742 | 49 | 218 |
| | | | | H/H | 715 | 15 | 144 | 718 | 23 | 150 |
| 17 | E | 50 | b | L/L | 712 | 65 | 208 | 794 | 184 | 342 |
| | | | | N/N | 711 | 17 | 144 | 731 | 39 | 172 |
| | | | | H/H | 713 | 16 | 145 | 716 | 22 | 149 |
| 18 | E | 80 | b | L/L | 706 | 18 | 154 | 768 | 106 | 243 |
| | | | | N/N | 708 | 11 | 141 | 716 | 19 | 150 |
| | | | | H/H | 707 | 11 | 142 | 708 | 12 | 143 |
| 19 | E | 95 | b | L/L | 707 | 20 | 155 | 765 | 82 | 218 |
| | | | | N/N | 704 | 13 | 144 | 708 | 17 | 150 |
| | | | | H/H | 705 | 11 | 141 | 706 | 14 | 142 |
| 20 | E | 99 | b | L/L | 705 | 14 | 150 | 749 | 59 | 197 |
| | | | | N/N | 706 | 8 | 141 | 701 | 12 | 144 |
| | | | | H/H | 706 | 8 | 140 | 703 | 9 | 141 |

$TiO_2$
E — manufactured by Ishihara Sangyo Kaisha, Ltd.: TTO-55A, grain-like, coated with $Al_2O_3$, 0.03 μm
binder resin
a — copolymer resin, manufactured by Toray Industries, Inc.: CM-8000
b — N-methoxymethyl nylon, manufactured by Teikoku Chemical Industry Co., Ltd.: EF-30T

TABLE 6

| Comp. | $TiO_2$ | | binder | | initial value (−V) | | | after 20000 cycle (−V) | | |
|---|---|---|---|---|---|---|---|---|---|---|
| Ex. | type | W % | resin | environment | $V_O$ | $V_R$ | $V_L$ | $V_O$ | $V_R$ | $V_L$ |
| 21 | F | 10 | a | L/L | 659 | 18 | 109 | 125 | 2 | 18 |
| | | | | N/N | 662 | 10 | 101 | 139 | 2 | 15 |
| | | | | H/H | 658 | 9 | 102 | 146 | 2 | 12 |
| 22 | F | 50 | a | L/L | 621 | 15 | 92 | 101 | 2 | 13 |
| | | | | N/N | 631 | 9 | 85 | 97 | 1 | 14 |
| | | | | H/H | 635 | 8 | 86 | 99 | 1 | 12 |
| 23 | F | 80 | a | L/L | 601 | 7 | 82 | 83 | 1 | 10 |
| | | | | N/N | 624 | 6 | 80 | 79 | 1 | 12 |
| | | | | H/H | 621 | 6 | 81 | 81 | 1 | 11 |
| 24 | F | 95 | a | L/L | 593 | 5 | 79 | 80 | 1 | 11 |
| | | | | N/N | 598 | 4 | 78 | 81 | 0 | 10 |
| | | | | H/H | 595 | 4 | 79 | 83 | 1 | 12 |
| 25 | F | 99 | a | L/L | 536 | 4 | 75 | 75 | 1 | 10 |
| | | | | N/N | 524 | 3 | 72 | 72 | 0 | 9 |
| | | | | H/H | 528 | 4 | 74 | 76 | 0 | 9 |
| 26 | F | 10 | b | L/L | 662 | 19 | 108 | 126 | 2 | 13 |
| | | | | N/N | 667 | 11 | 103 | 124 | 2 | 12 |
| | | | | H/H | 665 | 9 | 102 | 131 | 2 | 10 |
| 27 | F | 50 | b | L/L | 617 | 16 | 94 | 100 | 2 | 9 |
| | | | | N/N | 624 | 10 | 87 | 89 | 1 | 10 |
| | | | | H/H | 621 | 10 | 86 | 93 | 1 | 11 |
| 28 | F | 80 | b | L/L | 597 | 9 | 81 | 82 | 1 | 10 |
| | | | | N/N | 615 | 7 | 82 | 81 | 1 | 10 |
| | | | | H/H | 620 | 6 | 80 | 79 | 1 | 11 |
| 29 | F | 95 | b | L/L | 591 | 7 | 78 | 82 | 1 | 10 |
| | | | | N/N | 601 | 6 | 77 | 79 | 0 | 10 |
| | | | | H/H | 598 | 6 | 76 | 80 | 0 | 9 |
| 30 | F | 99 | b | L/L | 536 | 5 | 72 | 75 | 0 | 9 |

TABLE 6-continued

| Comp. | $TiO_2$ | | binder | | initial value (−V) | | | after 20000 cycle (−V) | | |
|---|---|---|---|---|---|---|---|---|---|---|
| Ex. | type | W % | resin | environment | $V_O$ | $V_R$ | $V_L$ | $V_O$ | $V_R$ | $V_L$ |
| | | | | N/N | 526 | 5 | 71 | 71 | 0 | 9 |
| | | | | H/H | 525 | 4 | 73 | 74 | 0 | 9 |

$TiO_2$
F — manufactured by Ishihara Sangyo Kaisha, Ltd.: FTL-1000, needle-like, of which surface is rendered to be conductive by being treated with $SnO_2$(Sb doped), 3 to 6 × 0.05 to 0.1 μm
binder resin
a — copolymer resin, manufactured by Toray Industries, Inc.: CM-8000
b — N-methoxymethyl nylon, manufactured by Teikoku Chemical Industrys Co., Ltd.: EF-30T

TABLE 7

| Photoconductor | needle-like $TiO_2$ wt % | solvent of coating solution for undercoating layer: composition part by weight | solvent of coating solution for undercoating layer: composition part by weight | coating solution for undercoating layer: dispersion | coating solution for undercoating layer: pot life | irregularities of undercoating layer: liquid lopping | irregularities of undercoating layer: irregulation | image irregularities: liquid lopping | image irregularities: irregulation | image irregularities: texture finess |
|---|---|---|---|---|---|---|---|---|---|---|
| Example 31 | 95 | methyl alcohol 28.70 | 1,2-dichloroethane 53.30 | ○ | 0 day | ○ | ○ | ○ | ○ | ○ |
| Example 32 | 95 | methyl alcohol 43.46 | 1,2-dichloropropane 38.54 | ○ | 0 day | ○ | ○ | ○ | ○ | ○ |
| Example 33 | 95 | methyl alcohol 10.33 | chloroform 71.67 | ○ | 0 day | ○ | ○ | ○ | ○ | ○ |
| Example 34 | 95 | methyl alcohol 25.50 | tetrahydrofuran 56.50 | ○ | 0 day | ○ | ○ | ○ | ○ | ○ |
| Example 35 | 95 | methyl alcohol 58.30 | toluene 23.70 | ○ | 0 day | ○ | ○ | ○ | ○ | ○ |
| Example 36 | 95 | methyl alcohol 41 | 1,2-dichloroethane 41 | ○ | 0 day | ○ | ○ | ○ | ○ | ○ |
| Example 37 | 95 | methyl alcohol 41 | 1,2-dichloropropane 41 | ○ | 0 day | ○ | ○ | ○ | ○ | ○ |
| Example 38 | 95 | methyl alcohol 41 | chloroform 41 | ○ | 0 day | ○ | ○ | ○ | ○ | ○ |
| Example 39 | 95 | methyl alcohol 41 | tetrahydrofuran 41 | ○ | 0 day | ○ | ○ | ○ | ○ | ○ |
| Example 40 | 95 | methyl alcohol 41 | toluene 41 | ○ | 0 day | ○ | ○ | ○ | ○ | ○ |
| Com. Ex. 31 | 95 | methyl alcohol 82 | — | X | 0 day | XX | X | X | X | XX |

Evaluation of dispersion:
○ favorable
Δ practically acceptable
X with aggregation
Evaluation of irregularities:
○ with no irregularities
Δ practically acceptable
X with irregularities
XX extremely inferior

TABLE 8

| Photoconductor | coating solution for undercoating layer: storage stability | coating solution for undercoating layer: pot life | irregularities of undercoating layer: liquid lopping | irregularities of undercoating layer: irregulation | image irregularities: liquid lopping | image irregularities: irregulation | image irregularities: texture finess |
|---|---|---|---|---|---|---|---|
| Example 41 | ○ | 30 days | ○ | ○ | ○ | ○ | ○ |
| Example 42 | ○ | 30 days | ○ | ○ | ○ | ○ | ○ |
| Example 43 | ○ | 30 days | ○ | ○ | ○ | ○ | ○ |
| Example 44 | ○ | 30 days | ○ | ○ | ○ | ○ | ○ |
| Example 45 | ○ | 30 days | ○ | ○ | ○ | ○ | ○ |
| Example 46 | ○ | 30 days | ○ | ○ | ○ | ○ | ○ |
| Example 47 | ○ | 30 days | ○ | ○ | ○ | ○ | ○ |
| Example 48 | ○ | 30 days | ○ | ○ | ○ | ○ | ○ |
| Example 49 | ○ | 30 days | ○ | ○ | ○ | ○ | Δ |

TABLE 8-continued

| Photoconductor | coating solution for undercoating layer: storage stability | coating solution for undercoating layer: pot life | irregularities of undercoating layer: liquid lopping | irregularities of undercoating layer: irregulation | image irregularities: liquid lopping | image irregularities: irregulation | image irregularities: texture finess |
|---|---|---|---|---|---|---|---|
| Example 50 | ○ | 30 days | ○ | ○ | ○ | ○ | Δ |
| Com. Ex. 32 | X | 30 days | XX | X | X | X | XX |

Evaluation of storage stability:
○ favorable
Δ practically acceptable
X with aggregation
Evaluation of irregularities:
○ with no irregularities
Δ practically acceptable
X with irregularities
XX extremely inferior

TABLE 9

| Photoconductor | pot life | turbidity |
|---|---|---|
| Example 51 | 0 day | 53 |
| Example 52 | 30 days | 58 |
| Example 53 | 0 day | 60 |
| Example 54 | 30 days | 67 |
| Com. Ex. 33 | 0 day | 395 |
| Com. Ex. 34 | 30 days | partially aggregated and sedimentated |
| Com. Ex. 35 | 0 day | totally aggregated and sedimentated |

TABLE 10

| Photoconductor | $TiO_2$: type | $TiO_2$: wt % | binder resin | irregularities of undercoating layer: liquid lopping | irregularities of undercoating layer: irregulation | image irregularities: liquid lopping | image irregularities: irregulation | image irregularities: texture finess | image irregularities: overlapping in white portion |
|---|---|---|---|---|---|---|---|---|---|
| Example 59 | A | 10 | a | ○ | ○ | ○ | ○ | ○ | ○ |
| Example 60 | A | 30 | a | ○ | ○ | ○ | ○ | ○ | ○ |
| Example 61 | A | 50 | a | ○ | ○ | ○ | ○ | ○ | ○ |
| Example 62 | A | 10 | b | ○ | ○ | ○ | ○ | ○ | ○ |
| Example 63 | A | 30 | b | ○ | ○ | ○ | ○ | ○ | ○ |
| Example 64 | A | 50 | b | ○ | ○ | ○ | ○ | ○ | ○ |
| Com. Ex. 39 | B | 10 | a | Δ | X | Δ | X | XX | XX |
| Com. Ex. 40 | B | 30 | a | X | X | X | X | X | XX |
| Com. Ex. 41 | B | 50 | a | X | X | X | X | X | X |
| Com. Ex. 42 | B | 10 | b | Δ | X | Δ | X | X | XX |
| Com. Ex. 43 | B | 30 | b | X | X | X | X | XX | XX |
| Com. Ex. 44 | B | 50 | b | X | X | X | X | X | X |

$TiO_2$
A: manufactured by Sakai Chemical Industry Co., Ltd.: STR-60N needle-like, not applied with surface treatment
B: manufactured by Ishihara Sangyo Kaisha, Ltd.: TTO-55N grain-like, not applied with surface treatment
binder resin
a: copolymer nylon, manufactured by Toray Industries, Inc.: CM 8000
b: N-methoxymethyl nylon, manufactured by Teikoku Chemical Industry Co., Ltd.: EF-30T
Evaluation of irregularities:
○ with no irregularities
Δ practically acceptable
X with irregularities
XX extremely inferior

TABLE 11

| Photoconductor | $TiO_2$ type | $TiO_2$ wt % | solvent of coating solution for undercoating layer: composition part by weight | solvent of coating solution for undercoating layer: composition part by weight | binder resin | irregularities of undercoating layer: liquid lopping | irregularities of undercoating layer: irregulation | image irregularities: liquid lopping | image irregularities: irregulation | image irregularities: texture finess | image irregularities: overlapping in white portion |
|---|---|---|---|---|---|---|---|---|---|---|---|
| Example 65 | A | 10 | methyl alcohol 43.46 | 1,2-dichloropropane 38.54 | a | O | O | O | O | O | O |
| Example 66 | A | 30 | methyl alcohol 43.46 | 1,2-dichloropropane 38.54 | a | O | O | O | O | O | O |
| Example 67 | A | 50 | methyl alcohol 43.46 | 1,2-dichloropropane 38.54 | a | O | O | O | O | O | O |
| Example 68 | A | 10 | methyl alcohol 43.46 | 1,2-dichloropropane 38.54 | b | O | O | O | O | O | O |
| Example 69 | A | 30 | methyl alcohol 43.46 | 1,2-dichloropropane 38.54 | b | O | O | O | O | O | O |
| Example 70 | A | 50 | methyl alcohol 43.46 | 1,2-dichloropropane 38.54 | b | O | O | O | O | O | O |
| Example 71 | A | 50 | methyl alcohol 10.33 | chloroform 71.67 | a | O | O | O | O | O | O |
| Example 72 | A | 50 | methyl alcohol 25.50 | tetrahydrofuran 56.50 | a | O | O | O | O | O | O |
| Example 73 | A | 50 | methyl alcohol 58.30 | toluene 23.70 | a | O | O | O | O | O | O |

$TiO_2$
A: manufactured by Sakai Chemical Industry Co., Ltd.: STR-60N needle-like, not applied with surface treatment
binder resin
a: copolymer nylon, manufactured by Toray Industries, Inc.: CM 8000
b: N-methoxymethyl nylon, manufactured by Teikoku Chemical Industry Co., Ltd.: EF-30T
Evaluation of irregularities:
O with no irregularities
Δ practically acceptable
X with irregularities
XX extremely inferior

What we claimed is:

1. An electrophotographic photoconductor comprising a conductive support, an undercoating layer provided on the conductive support and a photosensitive layer provided on the undercoating layer, in which the undercoating layer comprises needle-like titanium oxide particles and a binder resin, the needle-like titanium oxide particles having an aspect ratio of at least 1.5 and showing a volume resistance in the range from $10^5$ Ω·cm to $10^{10}$ Ω·cm under a loading pressure of 100 Kg/cm$^2$.

2. An electrophotographic photoconductor according to claim 1, in which the needle-like titanium oxide particles have a short axis S having a length of 1 μm or less and a long axis L having a length of 100 μm or less, and the aspect ratio of L/S ranges from 1.5 to 300.

3. An electrophotographic photoconductor according to claim 1, in which the needle-like titanium oxide particles have a short axis S having a length of 0.5 μm or less and a long axis L having a length of 10 μm or less, and the aspect ratio of L/S ranges from 2 to 10.

4. An electrophotographic photoconductor according to claim 1, in which the needle-like titanium oxide particles are contained in the undercoating layer ranging from 10 wt % to 99 wt %.

5. An electrophotographic photoconductor according to claim 1, in which the needle-like titanium oxide particles are contained in the undercoating layer ranging from 30 wt % to 99 wt %.

6. An electrophotographic photoconductor according to claim 1, in which the needle-like titanium oxide particles are contained in the undercoating layer ranging from 50 wt % to 95 wt %.

7. An electrophotographic photoconductor according to claim 1, in which the surface of the needle-like titanium oxide particles remains untreated.

8. An electrophotographic photoconductor according to claim 1, in which the binder resin is a polyamide resin.

9. An electrophotographic photoconductor according to claim 1, in which the needle-like titanium oxide particles have a short axis S having a length of 0.5 μm or less and a long axis L having a length of 10 μm or less and the aspect ratio of L/S ranges from 2 to 10, the needle-like titanium oxide being contained in the undercoating layer in the range from 50 wt % to 95 wt % and remaining the surface untreated.

* * * * *